United States Patent [19]

Heller

[11] Patent Number: 4,874,111

[45] Date of Patent: Oct. 17, 1989

[54] MULTI-COMPARTMENT REFUSE CONTAINER

[75] Inventor: Cletas Heller, Du Bois, Pa.

[73] Assignee: Heller Triangle Spring Co., Du bois, Pa.

[21] Appl. No.: 303,716

[22] Filed: Jan. 27, 1989

[51] Int. Cl.[4] ..... B65D 25/16

[52] U.S. Cl. ..... 220/404; 220/1 T; 220/22

[58] Field of Search ..... 220/1 T, 22, 400–407

[56] References Cited

U.S. PATENT DOCUMENTS

| | | | |
|---|---|---|---|
| 269,625 | 12/1882 | Blake | 220/404 |
| 617,445 | 1/1899 | Nathan . | |
| 652,331 | 6/1900 | Rudolph | 220/404 |
| 930,842 | 8/1909 | Conley . | |
| 2,625,973 | 1/1953 | Weldon | 220/401 |
| 3,219,195 | 11/1965 | Mize | 211/71 |
| 3,384,260 | 5/1968 | Buffington | 220/17 |
| 3,402,848 | 9/1968 | Busey | 220/404 |
| 3,648,875 | 3/1972 | Lundgren | 220/1 t |
| 3,720,346 | 3/1973 | Cypher | 220/22.3 |
| 3,807,598 | 4/1974 | Nutt | 220/1 T |
| 3,893,615 | 7/1975 | Johnson | 232/43.2 |
| 3,977,450 | 8/1976 | Schampier | 220/404 |
| 4,331,252 | 5/1982 | Carren et al. | 220/404 |
| 4,428,493 | 1/1984 | McDonough | 220/403 |
| 4,483,440 | 11/1984 | Ware | 220/404 |
| 4,560,096 | 12/1985 | Lucas et al. | 220/401 |

FOREIGN PATENT DOCUMENTS

| | | | |
|---|---|---|---|
| 8300820 | 10/1984 | Netherlands | 220/1 T |
| 0303970 | 9/1968 | Sweden | 220/404 |

*Primary Examiner*—Jimmy G. Foster

*Attorney, Agent, or Firm*—Buchanan Ingersoll; Michael L. Dever

[57] ABSTRACT

A multi-compartment refuse container is provided in which partitions provided within a container shell divide the container into a number of individual compartments. Pin holes provided on the top of each partition accept pins which are used to secure trash liners within each of the compartments. When used to collect refuse, each compartment can be dedicated to receive a certain form of recyclable refuse. This permits the easy collection and disposal of recyclable and non-recyclable refuse.

6 Claims, 1 Drawing Sheet

MULTI-COMPARTMENT REFUSE CONTAINER

BACKGROUND OF THE INVENTION

1. Field of the Invention

The present invention relates to the field of refuse containers. More particularly, the present invention relates to the field of refuse containers having multiple compartments provided therein.

2. Description of the Prior Art

Multiple compartment refuse containers have been used in the past to provide more than one collection unit at a given location. Cypher, U.S. Pat. No. 3,720,346, shows a compartmented trash receptacle in which each separate compartment is used for the collection of different trash materials. Cypher teaches that when a compartment if filled, the container is emptied through an opening in the cover into a separate trash container. Such a trash removal operation is clumsy and cumbersome. There is a need for an apparatus which provides for the collection and disposal of segregated trash in a single collection unit.

Johnson, U.S. Pat. No. 3,893,615, shows a multiple compartment refuse container in which a raised rim provided around the top of each opening serves as a means of hanging a garbage bag. The bag may be tucked under a rod fastened to the corner of the rim. Alternatively, the bag may be secured by using a series of long U-shaped clips. Such means to secure a garbage bag are adequate for a large container in which trash is directed in the center of the bag. However, in smaller containers designed for residential use, trash may be inserted into the container at or near an unsupported corner of the bag. This enhances the possibility that the trash slides behind the bag and is not collected. Moreover, such means require an external structure built around the container. This increases the size of the container which is a significant detriment to residential use. Consequently, there is a need for a multiple compartment trash container which is capable of securely supporting trash lines in each of its compartments without increasing the size of the container.

SUMMARY OF THE INVENTION

In order to satisfy the requirements of mandatory recycling, I provide a multiple compartment trash container. Partitions are provided in a container shell to form individual compartments therein. Each compartment is adapted to serve as an individual trash receptacle in and of itself. Ideally, the user of my trash container will separate his trash at the time it is disposed into the container. In this manner, each of the separate compartments of the trash container will contain uniform contents. The contents of each compartment can be finally disposed according to the requirements of the respective municipality.

In order to assist in the collection and removal of refuse in each compartment, I provide pin holes in the top surface of the partitions which form the side walls of each compartment. The pin holes are adapted to receive pins which are used to secure a plastic trash liner to the top surface of the partition. The plastic liner can be easily removed from the compartment when full and a replacement liner inserted thereafter.

To accommodate the pins in the partitions, a removable lid is provided. Preferably, the lid has indentations which align with the pins in the top of the partitions. The lid can thus be firmly secured to the container.

Alternatively, a raised lid having sufficient clearance over the pins can be used.

In a further embodiment of my invention, the lid is provided with a number of individual flip-lids which correspond to each compartment of the container. The flip-lids can be marked to identify which form of refuse is to be deposited therein.

DESCRIPTION OF THE PREFERRED EMBODIMENT

Figure 1:
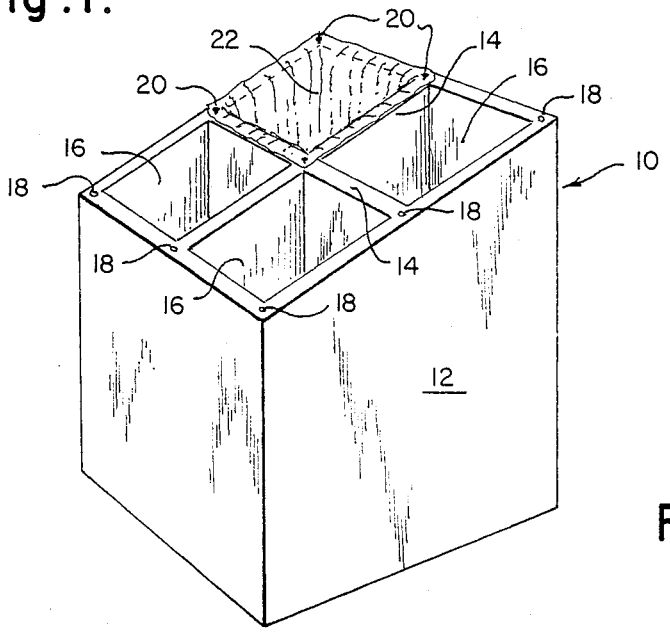
FIG. 1 is an isometric view of a preferred embodiment of the shell portion of the multicompartment refuse container of my invention.

As shown in FIG. 1, refuse container 10 includes an outer shell 12. Shell 12 is preferably either rectangular or circular in shape, but can be of any shape easily adapted for use in a home or business.

Partitions 14 are provided within shell 12 to form individual compartments 16. Preferably, partitions 14 are preformed with shell 12. Each of the compartments 16 are used to collect a different form of recyclable and non-recyclable refuse. The number and location of partitions 14 are selected based on the numbeer of compartments 16 needed and the sizes required for each compartment 16. Compartments 16 need not be of the same size, but can be of any size adequate to receive the refuse deposited therein. For ease of manufacture, compartments 16 are preferably the same size.

FIG. 1 shows the preferred design having four individual compartments 16 provided within shell 12. If shell 12 were circular in shape, each of the compartments 16 would preferably be sized as a quarter-circle.

Pin holes 18 are provided on the upper surface of partition 14. Pin holes 18 are adapted to receive pins 20. Preferably, a pin hole 18 is provided in each corner of compartment 16.

Pins 20 are adapted to hold secure a plastic trash liner 22 in each compartment 16. The trash liners 22, which can be of any generally available type, assist in the collection of refuse and in the easy removal of refuse from refuse container 10. Pins 20 pierce the trash liner 22 in each of its corners and secure the trash liner 22 in position by insertion into pin holes 18. Generally, the weight of refuse contained in each trash liner 22 will be light enough so that the liner 22 will not tear as a result of the pin pierce. Alternatively, a specially designed trash liner 22 adapted to receive pins 20 can be used.

Figure 2:
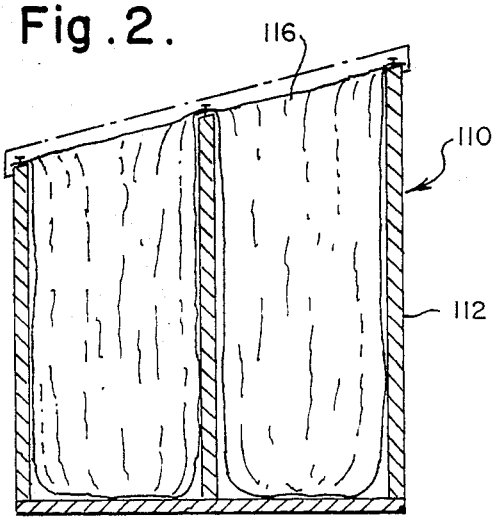
FIG. 2 is a side elevational view of an alternative preferred embodiment of the shell portion of the multicompartment refuse container of my invention.

In FIG. 1, I show the top of shell 12 being generally horizontal. FIG. 2 shows an alternative embodiment of container 110 in which the top of shell 112 slopes downward. Preferably, such a container 110 is placed along a wall with the taller portion of shell 112 abutting the wall. Such a container 110 provides easier access to those compartments 116 in the back portion of the shell 112.

Figure 3:
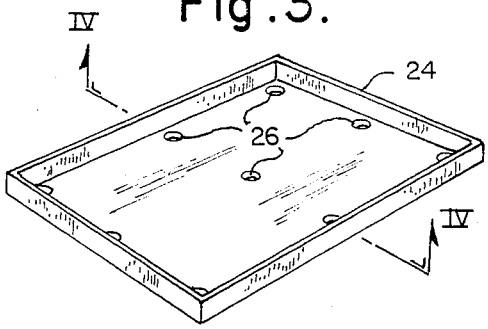
FIG. 3 is a bottom view of a preferred embodiment of the lid to be used with the shell portion of the refuse container of FIG. 1.

FIG. 3 shows the underside of the lid 24 adapted to fit over shell 12. Indentations 26 are provided along the underside of lid 24 to correspond with pins 20 on partitions 14. Provided the compartments 18 are of identical size and shape, lid 24 can be inserted over shell 12 in any configuration without affecting the operation of refuse container 10. If compartments 16 are not of identical size and shape, lid 24 would have only one correct alignment with respect to shell 12.

Figure 5:
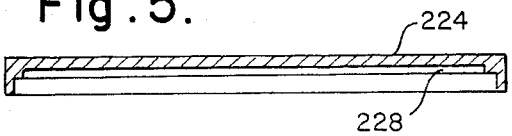
FIG. 5 is a cross-sectional view of an alternative embodiment of the lid to be used with the shell portion of the refuse container of FIG. 1.
Figure 4:
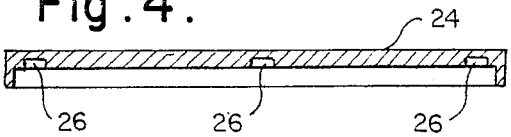
FIG. 4 is a cross-sectional view of the lid of FIG. 3 taken along line IV—IV.

FIG. 4 shows a cross-section of lid 24. Therein, the indentations 26 can be seen to occupy space formerly filled by lid 24. Alternatively, as shown in FIG. 5, lid 224 can be used having a raised central portion 228 which provides sufficient clearance over pins 18.

To collect refuse, lid 24 is removed and the refuse is deposited into the appropriate compartment 16. Thereafter, lid 24 is secured again on to shell 12. Whenever a compartment 16 is full, its contents are emptied by removing the trash liner 22 provided therein. A new trash liner 22 is then inserted into compartment 16 and the refuse container 10 is against able to collect refuse.

Figure 6:
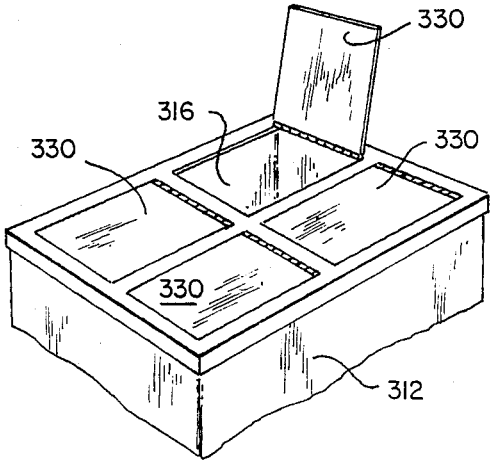
FIG. 6 is an isometric view of an alternative preferred embodiment of a lid to be used with the refuse container of FIG. 1.

FIG. 6 shows a further enhancement of lid 324. Individual flip lids 330 are provided within lid 324 to correspond to each of compartments 316. If desired, each of the flip lids 330 can be labeled to identify the contents of the compartments 316 thereunder. When the flip lids 330 are so labeled, lid 324 has only one correct alignment with respect to shell 312. Refuse is deposited into the appropriate flip-lid 330 until any one of compartments 316 is full. At that time, lid 324 is removed from shell 312 and the full compartment 316 is emptied of its contents.

As shown in FIG. 1, each pin 20 and pin hole 18 can be used to secure more than one trash liner 22. If desired, extra pin holes 18 may be added to partition 14 so that each pin 20 and pin hole 18 secure only a single trash liner 22. Lid 24 is modified accordingly to provide a secure fit onto shell 12.

In the foregoing specification, I have set out certain preferred practices and embodiments of this invention. However, it will be understood that this invention may be otherwise embodied within the scope of the following claims.

I claim:

1. A multiple compartment refuse container comprising:

(a) a container, said container provided with at least one internal partition, said at least one partition dividing said container into at least two compartments, each of said compartments adapted to receive a trash liner;

(b) a plurality of pin receiving members provided on a top surface of said at least one partition;

(c) a plurality of pins sized to fit into said pin receiving members on said at least one partition, said pins adapted to secure said trash liners in each of said compartments; and (d) a removable lid sized and positioned to fit over and seal said container.

2. The container of claim 1 wherein said lid further comprises at least two flip lids, one of said flip lids positioned above each of said compartments.

3. The container of claim 1 wherein each of said plurality of pins corresponds to only one compartment.

4. The container of claim 1 wherein said lid further comprises a plurality of indentations sized and positioned to receive the heads of said plurality of pins.

5. The container of claim 1 wherein said lid further comprises a raised central body adapted to provide clearance between said lid and said plurality of pins.

6. The container of claim 1 wherein said container has at least two rows of containers, a top surface of said container is sloped downward from a first of said at least two rows of containers to a second of said at least two rows of containers.

* * * * *